US006752348B2

(12) United States Patent
Dreckmann et al.

(10) Patent No.: US 6,752,348 B2
(45) Date of Patent: Jun. 22, 2004

(54) WINDING DEVICE, AND METHOD FOR PERFORMING A WINDING SHAFT CHANGE IN A WINDING DEVICE

(75) Inventors: Karl Dreckmann, Hennef (DE); Andreas Böhm, Troisdorf (DE)

(73) Assignee: Reifenhäuser GmbH & Co. Maschinenfabrik, Troisdorf (DE)

( * ) Notice: Subject to any disclaimer, the term of this patent is extended or adjusted under 35 U.S.C. 154(b) by 35 days.

(21) Appl. No.: 10/117,684

(22) Filed: Apr. 5, 2002

(65) Prior Publication Data

US 2002/0179769 A1 Dec. 5, 2002

(30) Foreign Application Priority Data

Apr. 5, 2001 (DE) ..... 101 16 973

(51) Int. Cl.[7] ..... B65H 18/14

(52) U.S. Cl. ..... 242/542.3; 242/527.3; 242/532.2

(58) Field of Search ..... 242/527.2, 527.3, 242/527.4, 532.2, 532.3, 542.3

(56) References Cited

U.S. PATENT DOCUMENTS

| | | | | | |
|---|---|---|---|---|---|
| 3,350,027 | A | | 10/1967 | Egan | |
| 4,196,865 | A | * | 4/1980 | Patriksson | 242/532.2 |
| 4,444,362 | A | * | 4/1984 | Karr | 242/532.2 |
| 4,445,646 | A | * | 5/1984 | Karr et al. | 242/532.2 |
| 4,456,190 | A | * | 6/1984 | Karttunen et al. | 242/527.3 |
| 4,695,004 | A | * | 9/1987 | Grossmann et al. | 242/532.2 |
| 4,770,358 | A | | 9/1988 | Suzuki et al. | |
| 4,798,351 | A | | 1/1989 | Halter et al. | |
| 4,852,820 | A | * | 8/1989 | Looser | 242/527.2 |
| 5,314,132 | A | * | 5/1994 | Ando et al. | 242/532.3 |
| 5,954,291 | A | * | 9/1999 | Meinecke et al. | 242/542.3 |
| 6,029,927 | A | * | 2/2000 | Wohlfahrt et al. | 242/527.2 |
| 6,045,085 | A | * | 4/2000 | Andersson et al. | 242/532.3 |
| 6,149,099 | A | * | 11/2000 | Meinecke et al. | 242/542.3 |
| 6,474,589 | B1 | * | 11/2002 | Enwald et al. | 242/532.3 |

FOREIGN PATENT DOCUMENTS

| | | |
|---|---|---|
| DE | 1 574 426 | 1/1972 |
| DE | 36 30 572 | 5/1990 |
| DE | 42 13 712 | 3/1995 |
| DE | 197 19 048 A1 | 11/1998 |
| EP | 0 995 708 A2 | 4/2000 |
| JP | 58-17048 | 2/1983 |
| JP | 60-197556 | 10/1985 |
| JP | 61-130164 | 6/1986 |

* cited by examiner

*Primary Examiner*—William A. Rivera
(74) *Attorney, Agent, or Firm*—Pauley Petersen & Erickson

(57) ABSTRACT

A method and a device for winding a continuously arriving foil web into a coil on a winding shaft, having a rotatably driveable contact roller, a winding station assigned to the contact roller for the winding shaft for winding the coil, a take-up station for receiving a fresh winding shaft and taking up the foil web, a transverse cutting device between the winding station and the take-up station for transversely cutting the foil web, wherein a charging station for creating an electrostatic charge between the winding shaft and the foil web and a blower device are assigned to the take-up station for the fresh winding shaft.

14 Claims, 5 Drawing Sheets

WINDING DEVICE, AND METHOD FOR PERFORMING A WINDING SHAFT CHANGE IN A WINDING DEVICE

BACKGROUND OF THE INVENTION

1. Field of the Invention

This invention relates to a device for winding up a continuously arriving foil web into a coil on a winding shaft, including a rotatably driveable contact roller for feeding the foil web in a conveying device, as well as the following assigned to the contact roller: a wind-up station for the winding shaft for winding the coil; a take-up station for receiving a fresh winding shaft which is used during a winding shaft change in the winding station, for being exchanged with the winding shaft on which a coil of the foil web has been wound; and a transverse cutting device for transversely cutting the foil web between the winding station and the take-up station, wherein during a winding shaft change the winding shaft supporting the coil can be removed out of the winding station, the transverse cutting device for transversely cutting the foil web can be moved from a position of rest into a working position, and while cutting the foil web a leading end piece of the following foil web is formed, the leading end piece of the foil web thus formed can be conducted to the fresh winding shaft located in the take-up station and can be wound on the fresh winding shaft, and after receiving the leading end piece of the foil web the fresh winding shaft can be transferred from the take-up station into the winding station.

This invention also relates furthermore to a method for winding a continuously arriving foil web into a coil on a winding shaft and to the performance of a winding shaft change for exchanging the winding shaft on which a coil has been wound for a fresh winding shaft, having a winding device with a contact roller, over which the foil web is supplied and is received on a winding shaft rolling off on the contact roller and is wound to form a coil, and having a transverse cutting device for the foil web for cutting the foil web while forming a leading end of the following cut-off foil web for placing it on a fresh winding shaft, as well as a conveying device for conveying in a fresh winding shaft to be exchanged for the winding shaft on which the coil has been wound during a winding shaft change, wherein at the start of the winding shaft change the fresh winding shaft is placed on the contact roller while forming a contact gap, and the foil web is cut either prior to passing through the contact gap or after having passed through the contact gap, and the leading end of the foil web formed while cutting is taken up by the fresh winding shaft.

2. Description of Related Art

Winding devices are distinguished because the continuously arriving foil web is continuously wound into a coil wherein, after a preset coil diameter is reached, the passing on of the coil wound on the winding shaft and the supply of a fresh winding shaft for forming a new coil from the foil web occurs in an automated fashion without it necessary to interrupt the continuous feeding of the foil web. Such winding devices with automatically performed winding shaft changes are known from German Patent Reference DE-AS 15 74 426 and U.S. Pat. No. 3,350,027.

A winding device of the species is described, for example, in German Patent Reference DE 42 13 712 C2, the entire disclosure of which are explicitly included in this specification, by reference.

During a winding shaft change, up to now the leading end piece of the following foil web formed by the transversely cutting device has been usually taken up by the fresh winding shaft, or by a cardboard tube arranged on the fresh winding shaft, in such a way that the circumference of the winding shaft has an adhesive, for example an adhesive strip, to which the leading end piece of the foil web adheres while passing through the take-up station and which is taken up by the fresh winding shaft in the take-up station. Although this method has proven itself in actual use, it cannot always be advantageously performed in connection with all types of foil webs, in particular plastic foil webs, because adhesive residue sticking to the foil web can inevitably have a disadvantageous effect during further processing of the foil web wound into a coil. Also, the application of an adhesive, for example in the form of adhesive strips, is undesirably expensive.

Therefore various attempts have been made to perform the take-up of the leading end piece of the foil web formed during a winding shaft change without the aid of an adhesive, which is called an adhesive-free take-up.

It is known from German Patent Reference DE 36 30 572 C2 to forcibly supply the leading end piece, formed by the transverse cutting device, to the fresh winding shaft by a pressure device, which surrounds the winding shaft over the circumference, having a circulating conveyor belt, and assisted by appropriately directed blast air, so that this leading end piece of the foil web is taken up by the fresh winding shaft. However, it has been shown in actual use that a pressure device with a circulating pressure belt does not make possible satisfactory and dependable take-up of the leading end piece on the fresh winding shaft under all operational conditions and that it fails, in particular above a certain conveying speed of the continuously fed foil web and above a certain thickness of the foil web.

SUMMARY OF THE INVENTION

It is one object of this invention to provide a winding device of the type mentioned above but with a dependable and assured take-up of the leading end piece of the foil web formed by the transverse cutting device on the fresh winding shaft, performed even at high conveying speeds and/or large foil thickness of the continuously fed foil web, without it necessary to use an adhesive.

The embodiments of a winding device in accordance with the distinguishing characteristics set forth in the claims and in this specification can be used to achieve this object.

A method of this invention for performing a winding shaft change in the sense of the above described object of this invention is described in the claims and in this specification.

This invention can be employed in connection with a winding device having main components that are known per se, such as described in German Patent Reference DE 42 13 712 C2. In accordance with this invention, the known winding device is modified to attain the stated object in order to make possible desired adhesive-free winding of the leading end piece of the foil web on a fresh winding shaft during a winding shaft change.

In accordance with this invention, in the conveying direction of the foil web, a charging device and a blower device are provided downstream of the take-up station receiving the fresh winding shaft. The leading end piece of the foil web formed by the transverse cutting device can be electrostatically charged by the charging device. A blast air stream can be generated by the blower device, which acts on the end piece of the foil web in the area between the contact roller and the end piece of the foil web.

Therefore the winding device in accordance with this invention makes use of an electrostatic charge of the leading end piece of the foil web for receiving the leading end piece of the foil web on the fresh winding shaft, by which the leading end of the foil web automatically adheres to the circumference of the fresh winding shaft and is taken up by the latter, so that the continuous winding of the foil web proceeds without interruption. Adhesive is no longer required. To aid the placement of the leading, electrostatically charged end of the foil web on the circumference of the fresh winding shaft, the blast air is directed toward the circumference of the fresh winding shaft and on the side of the foil web facing away from the fresh winding shaft, so that the electrostatically charged leading end of the foil web is guided toward the fresh winding shaft and adheres to the winding shaft because of the electrostatic charge.

A field of electrical tension is formed between the foil web and the winding shaft by the charging device. A winding shaft according to this invention is also considered to be a winding shaft with a winding tube pushed on it, for example a cardboard tube.

The method of this invention, for performing a winding shaft change in the winding device for the foil web, particularly those made of plastic, is distinguished because the leading end piece of the foil web is electrostatically charged and is deflected toward the circumference of the fresh winding shaft by blast air.

The charging device can preferably be formed by a charging electrode extending transversely over the entire width of the foil web. Such charging electrodes are commercially available for various applications.

Different charging methods are basically available here. For one, it is possible to connect the charging electrode with a direct current (d.c.) voltage source, while the remaining parts of the winding device of this invention are grounded, therefore also the winding shaft. Because of the electrostatic field generated, the foil web will temporarily adhere to the reference ground, in the present case to the circumference of the winding shaft because of the deflection by blast air.

It is also possible to connect the charging device to a d.c. voltage source and to let the foil web pass between the charging electrode and an a.c. voltage ion spray device, by which it is also possible to achieve the desired electrostatic charge of the foil web.

To produce a sufficient adherence of the leading end piece of the foil web at the circumference of the fresh winding shaft, the discharging device is advantageously charged with an electrical potential of up to 40 kV.

The blower device of the winding device of this invention advantageously comprises a plurality of blast jets arranged over the entire width of the foil web, which are evenly charged with compressed air from an appropriate compressed air source. Because of the charging electrode extending over the entire width of the foil web, and because of the multitude of blast jets arranged over the entire width of the foil web, which advantageously also are at equal distances from each other, the leading end piece of the foil web is evenly placed against the circumference of the fresh winding shaft and is taken up by the fresh winding shaft.

Also, the blower device and/or the discharging device can be arranged on a pivotable holder and, in case of a winding shaft change, can be moved from a position of rest into a working position and, following the end of the winding shaft change, back again into the position of rest, so that they are in the working position only for the length of the winding shaft change, but in the remaining time are assigned to a protected position of rest, in which they do not hinder the further functioning of the winding device.

In another embodiment of the winding device of this invention, the contact roller is perforated in the area of its circumference and the blower device is arranged inside the contact roller and has at least one blast air conduit with a blower jet, which is conducted to a circumferential area of the contact roller which, viewed in the conveying direction of the foil web, is located downstream of the take-up station. Blast air can be generated from the blast air conduit through the perforated circumference of the contact roller, in the direction toward the circumference of the fresh winding shaft. With a blower device embodied this way, it is possible to effectively assist removal of the foil web from the contact roller and its placement on the fresh winding shaft rolling off on it. It is also possible to put the blower device together from both of the above mentioned variations, for example with a plurality of blower jets arranged over the entire width of the foil web, as well as a blast air conduit embodied inside the contact roller, which directs blast air on the foil web through the perforated circumference of the contact roller.

Also, it is possible to activate the charging device and the blower device only during the time of the winding shaft change with an appropriate control, but to deactivate it during the remaining operating time of the winding device of this invention, because during that time the operation of the charging device and of the blower device are not required. This activation as needed of the charging and blower devices can be integrated without problems into the running control of the winding device in accordance with this invention.

This invention can be advantageously employed in the described manner in connection with a winding device in accordance with German Patent Reference DE 42 13 712 C2, wherein the contact roller is selectively driven in different directions, so that the foil web is wound up into a coil of the desired orientation.

A method in accordance with this invention, for executing a winding shaft change in connection with a winding device of this invention, for performing a winding shaft change, has the transverse cutting device moved into a position between the take-up station and the winding station. The fresh winding shaft is brought into the take-up station by the conveying device, wherein the fresh winding shaft is put into a rotating movement on the contact roller prior to being deposited in the take-up station. The charging device is switched on as soon as the fresh winding shaft rests on the contact roller while forming a contact gap, wherein the electrostatic charge is provided by an electrical voltage drop between the foil web and the fresh winding shaft. Then the transverse cutting device is activated and the foil web is cut by the transverse cutter. The blower device is activated simultaneously with the transverse cutting of the foil web and an air flow is generated, wherein the new leading end piece of the following foil web formed in the transverse cutting device is lifted by the air flow and is conducted against the fresh winding shaft by the static charge and is wound up. Also, the winding shaft in the winding station, on which the coil is wound, is removed from the winding station. Thereafter, the fresh winding shaft with the taken-up end piece of the foil web is transferred from the take-up station to the winding station for winding a new coil.

It is obvious that the winding device of this invention and the method of this invention, which relate to a charging device and a blower device for placing the leading end piece of the foil web on the circumference of the fresh winding shaft without the use of adhesives, can also be retrofitted with little cost outlay in already installed winding devices. It is thus only necessary to arrange a suitable blower device and appropriate charging device in a suitable manner and position them on the winding device already installed in an installation for producing and winding foils and to integrate it into the running control. Thus, the take-up free of adhesives which is possible with this invention can be retrofitted with little cost outlay in already existing winding devices of various designs.

BRIEF DESCRIPTION OF THE DRAWINGS

This invention is explained in greater detail in view of exemplary embodiments represented in the drawings, wherein.

DESCRIPTION OF PREFERRED EMBODIMENTS

Figure 1:
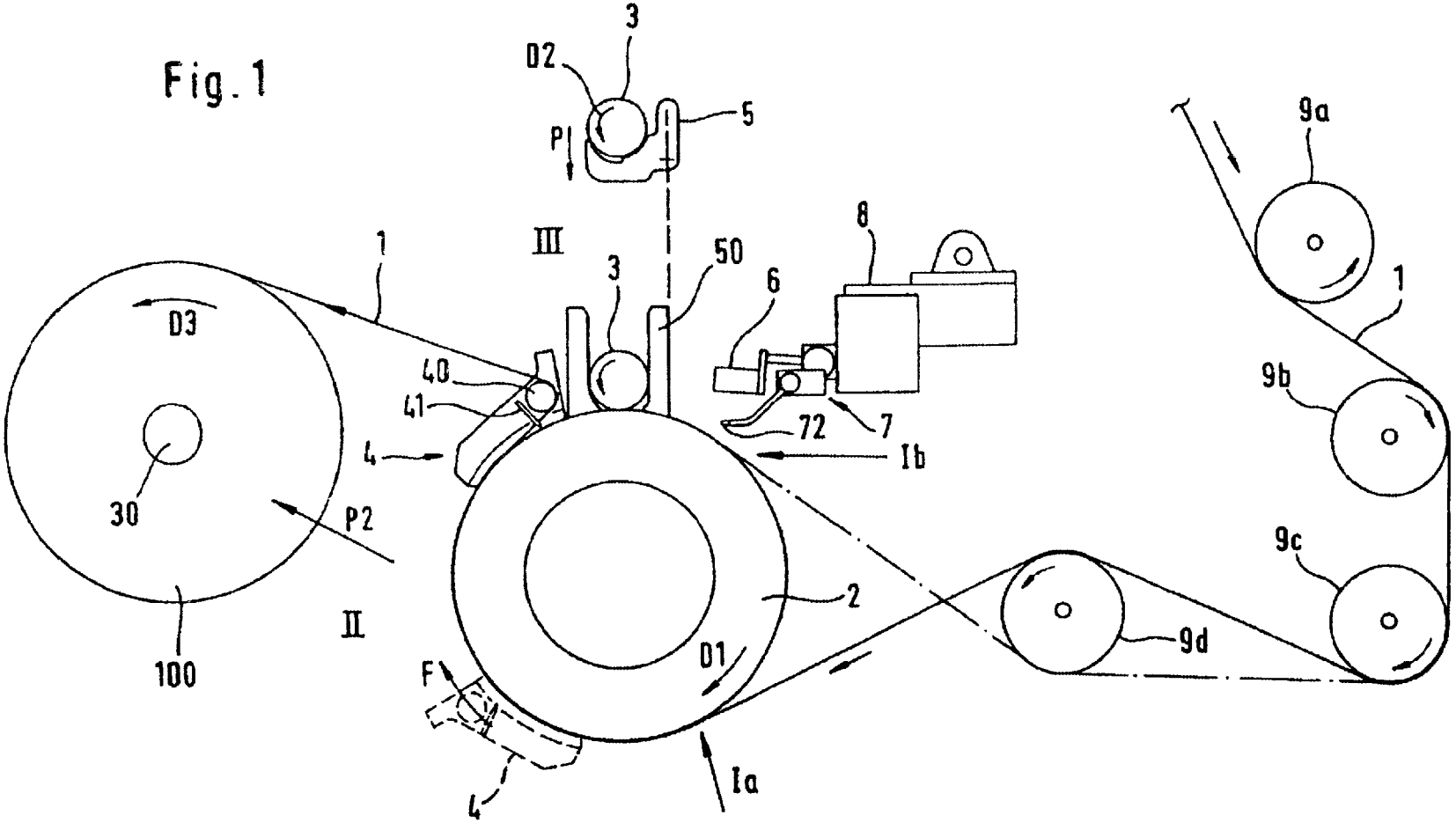
FIG. 1 shows a schematic representation in a lateral view of a winding device in accordance with this invention, having a contact roller for alternating directions of rotation.

A winding device for winding a continuously arriving foil web 1, in particular a plastic foil web, is shown in FIG. 1 in a greatly simplified schematic representation. The essential components for performing the winding process are represented. The foil web 1 is fed to a contact roller 2 from an extrusion device, not represented, such as a blown film extrusion device or a flat foil extrusion device, via a multitude of reversing rollers 9*a*, 9*b*, 9*c*, 9*d*. The contact roller 2 is driven by means of a motor, not represented, and can rotate either in a clockwise direction D1, or in a counterclockwise direction. In accordance with the exemplary embodiment in FIG. 1, the contact roller 2 rotates in a clockwise direction D1, and the foil web 1 is conducted on the contact roller 2 at the inlet station Ia. If the contact roller 2 is rotated counterclockwise, the foil web 1 runs on the contact roller 2 at the inlet station Ib, as indicated by dashed lines. The foil web 1 fed at Ia to the contact roller 2 is taken along by the contact roller 2 to the winding station II and is transferred there to a winding shaft 30, see FIG. 2*a*, and wound into a coil 100. The winding shaft 30, or the coil being slowly wound-up, is rotated by contact with the contact roller 2, in the direction of rotation D3. The winding shaft 30 with the wound-on coil 100, located in the winding station II, can be removed in the direction of the arrow P2 from the contact roller 2 once the coil 100 has reached the desired size. In the illustrated example, the winding station II is associated with the contact roller 2 at the nine o'clock position. The take-up station III with a conveying device 5 for the fresh winding shaft 3 is assigned to the twelve o'clock position of the contact roller 2. The take-up station also comprises a bearing receiver 50 for the fresh winding shaft 3, as well as the blower device 7 with blast jets 72, the charging device 6, and the pivotable holding device 8 for the charging device 6 and the blower device 7.

The transverse cutting device 4 comprises a transverse cutter 41, as well as a deflection roller 40 for the foil web 1. When the winding shaft on which the coil has been wound is removed in the direction of the arrow P2 from the winding station II, the transverse cutting device 4 can be pivoted in the direction of the arrow F out of a position of rest in the area between the inlet station Ia and the winding station II into the active position represented in FIG. 1, but also see FIGS. 2*a* and 2*b*. The active position of the transverse cutting device for the purpose of cutting the foil web 1 is located between the winding station II and the take-up station III.

Winding of the foil web 1 and the winding shaft change is explained in view of FIGS. 1, 2*a*, 2*b* and 3. The foil web 1 runs up in the conveying direction P1 of the contact roller 2 rotating in the direction of rotation D1 in the inlet station Ia, which corresponds to a five o'clock position, and is taken along by the contact roller 2 to the winding station II. The winding station II is in the nine o'clock position with respect to the contact roller 2, and the foil web 1 is wound into a coil 100 on the winding shaft 30, rotating along in the direction of the arrow D3 by contact with the contact roller 2. The winding roller 30 is rotatably and displaceably seated and makes it possible for the coil 100 to roll off on the contact roller 2.

Figure 2A:
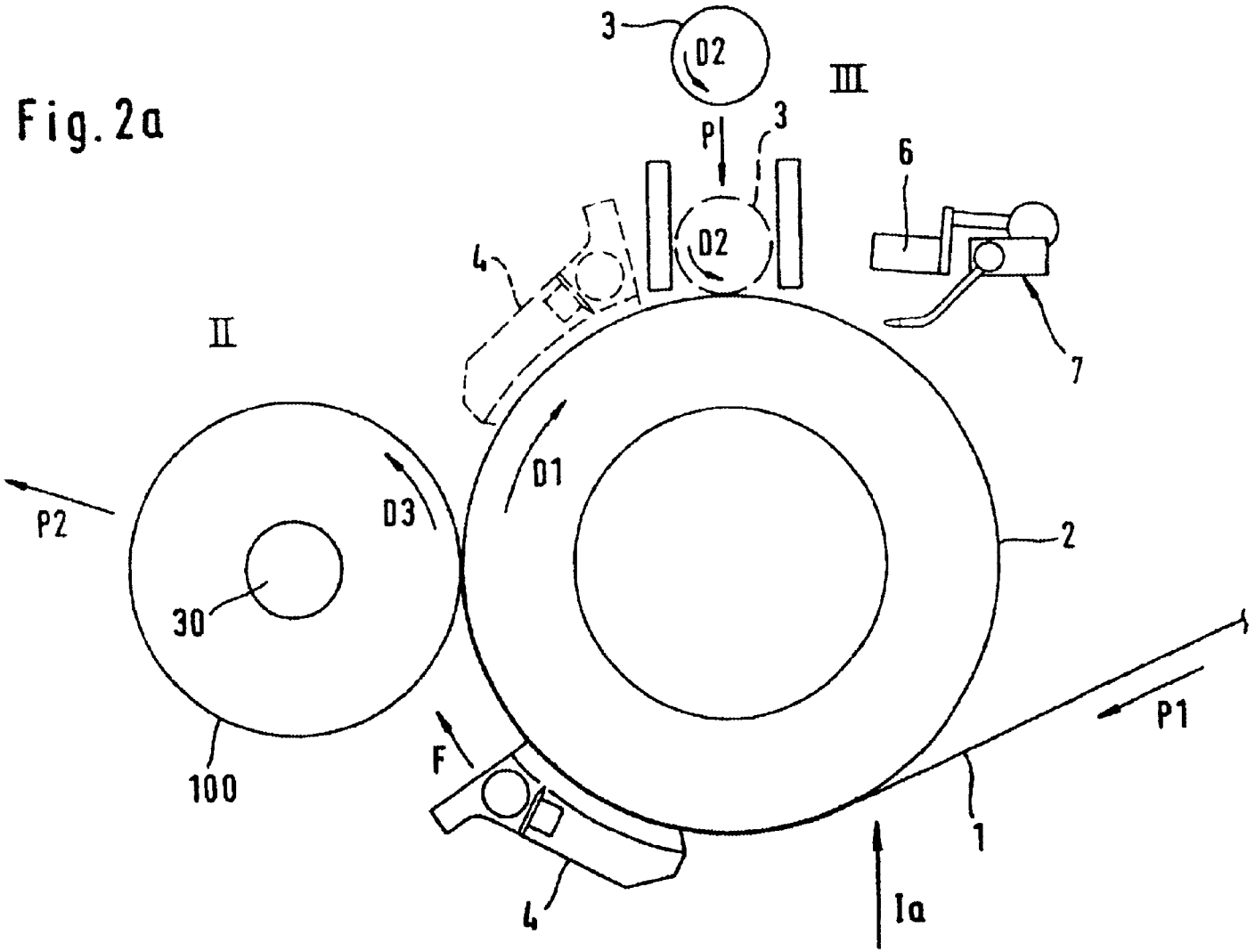
FIG. 2*a* is a schematic representation of a winding process using the winding device of FIG. 1.
Figure 2B:
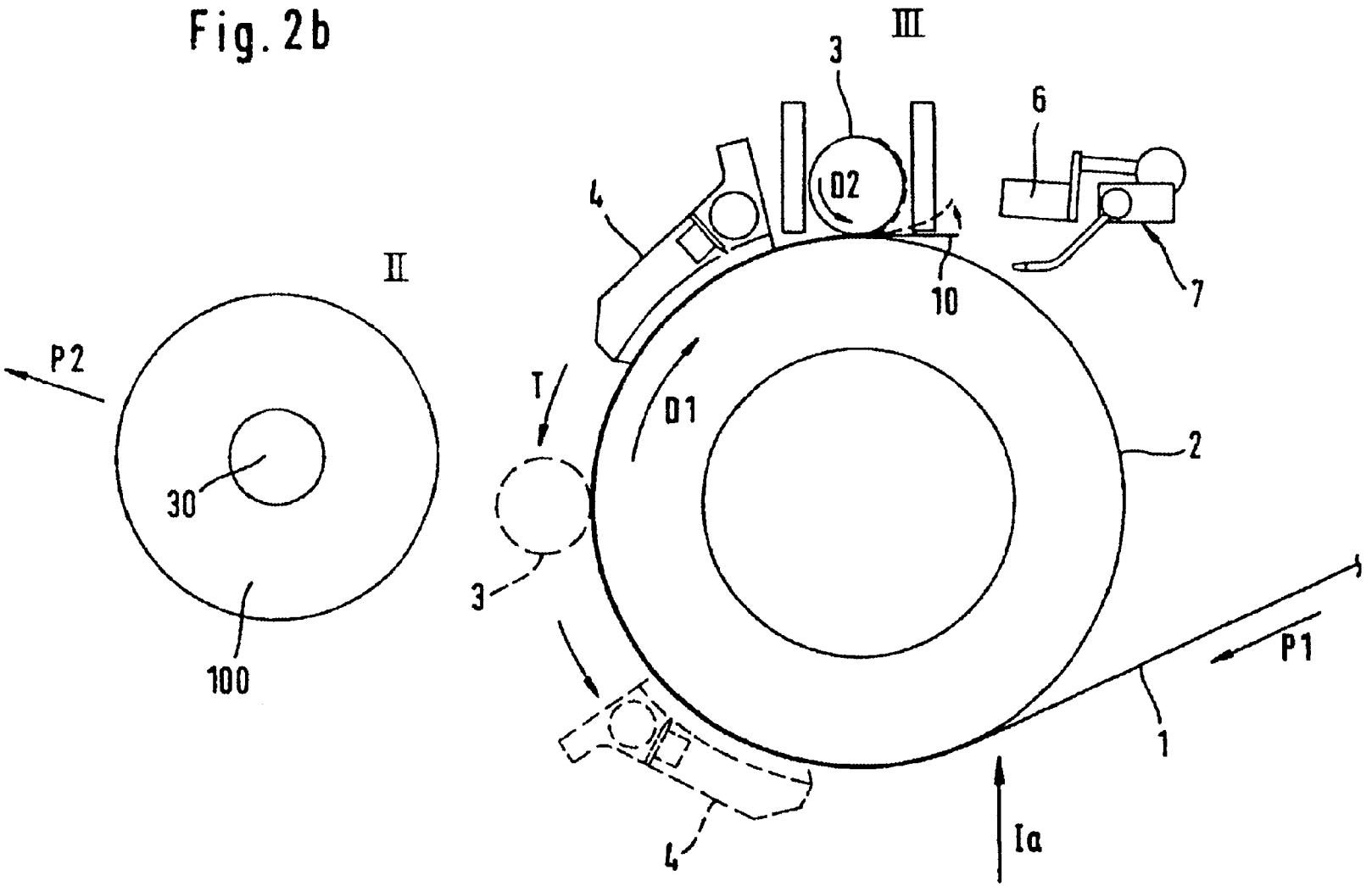
FIG. 2*b* is a schematic representation of a winding shaft change of the winding device of FIG. 1.

Once the coil 100 has reached a predetermined circumference, for example the desired length of the foil web has been wound up, a winding shaft change is performed, wherein the full winding shaft 30 wound with the coil 100 is removed in the direction of the arrow P2 and a fresh, still empty winding shaft 3 is inserted into the station II, as shown in FIG. 2*b*. The station III is provided for this winding shaft change in the twelve o'clock position with respect to the contact roller 2, into which a fresh, still empty winding shaft 3 is inserted and brought into contact with the contact roller 2. The fresh winding shaft 3 is taken from a reservoir, not represented, by a conveying device 5, which at the same time comprises a device for rotating and accelerating the winding shaft 3 in the direction of rotation D2, so that the winding shaft 3 can be inserted out of the conveying device 5 in the direction of the arrow P into the bearing receiver 50 at the contact roller 2 when the winding shaft 3 has reached the desired number of revolutions. The fresh winding shaft is placed on the contact roller 2 and forms a contact gap, and is rotated along in the direction D2 by the contact roller.

Viewed in the conveying direction of the contact roller 2, the charging device 6 and the blower device 7 for blast air are arranged downstream of the take-up station III.

Figure 3:
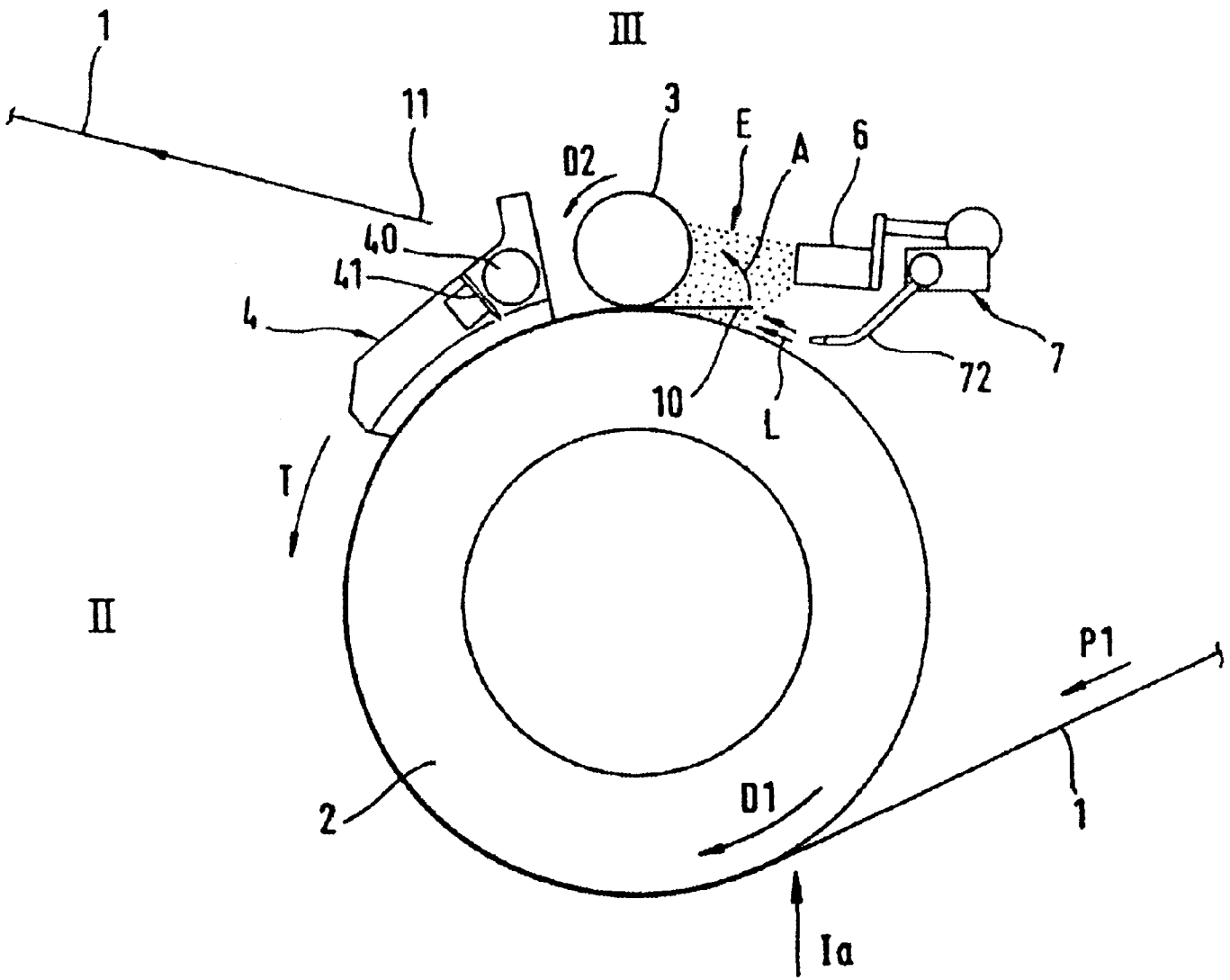
FIG. 3 is an enlarged schematic representation of portions of the process of take-up using a fresh winding shaft.

As shown in FIG. 2*a*, during continuous winding of the foil web 1 to form the coil 100, the transverse cutting device 4 is in a position between the inlet station Ia and the winding station II. For the winding shaft change to be performed, for example the exchange of the full winding shaft 30 in the winding station II for the fresh winding shaft 3, the full winding shaft 30, 100 in the winding station II is removed from the contact roller 2 in the direction of the arrow P2, and the transverse cutting device 4 moves in the direction of the arrow F between the contact roller 2 and the winding shaft 30 on which the coil has been wound into the cutting position, as shown in FIG. 2*a* and represented in FIGS. 1, 2*b* and 3. On its way, the transverse cutting device 4 takes the foil web 1 along, which is now conducted off the contact roller 2 via a deflection roller 40 arranged on the transverse cutting device 4 and continues to run from there in order to be wound up as the coil 100 on the winding shaft 30. Thereafter, the fresh winding roller 3, being accelerated to its number of revolutions D2, is inserted via the conveying device 5 into the bearing receiver 50 in the take-up station III until it touches the contact roller 2 and is taken along. As soon as the fresh winding shaft 3 rests on the contact roller 2, see FIG. 2*b*, or FIGS. 1 and 3, the static charge device 6 is switched on. The transverse cutter 41 of the transverse cutting device 4 is now activated and severs the foil web 1 guided around the transverse cutting device 4 in the position, as shown in FIG. 1 and FIG. 3, shortly before reaching the take-up station III. The blower device 7 is activated parallel with the severing process and blast air is blown out of the jets 72 in the direction toward the fresh winding shaft 3. As a result of the transverse cutting of the foil web 1 by the transverse cutter 41, the trailing end 11 of leading foil web 1 is drawn off in the direction toward the winding shaft 30 in the winding station II, see FIG. 1 and FIG. 3, and forms the end of the coil 100. The leading new end piece 10 of the foil web 1, however, remains on the contact roller 2 and is conveyed with the contact roller 2 in the direction toward the take-up station III and is conducted through the contact gap between the contact roller 2 and the winding shaft 3, as shown in FIG. 2*b* and FIG. 3. As soon as the leading end piece 10 of the foil web 1 has passed through the contact gap, it enters the voltage field E, which has been built up between the winding shaft and the foil web, or its end piece 10, by the charging device 6, and is affected as well by the air flow L from the blower device 7, which is also shown in FIG. 3.

The end piece 10 of the leading foil web 1 is lifted in the direction of the arrow A by the flow of air between the surface of the contact roller 2 and the end piece 10 of the foil web and, because of the static charge E, voltage field E between the grounded winding shaft and the foil web, is conducted to the fresh winding shaft 3 and adheres to it and is taken along by it in the direction of rotation D2, so that the foil end 10 is again wound up. During this take-up of the foil end on the fresh winding shaft 3 in the take-up station III, the winding shaft 30 with the coil 100 wound on it is completely removed from the winding station II, and the transverse cutting device 4 is also again pivoted back into its rest position between the winding station II and the inlet station Ia, as shown in FIG. 2*b*. Now the winding shaft 3 with the picked-up end piece 10 of the foil web 1 can be pivoted in the direction of the arrow T out of the take-up station III into the winding station II, as shown in FIG. 2*b*. Then the further winding process of the foil web 1 onto the fresh winding shaft 3, as shown in FIG. 2*a* and described, can be performed in the winding station II.

The process of the adhesive-free take-up of the end piece 10 of the foil web 1 is schematically represented in FIG. 3. The charging device 6 in the form of a charging electrode extending over the entire width of the foil web, as well as a blower device 7 in the form of a multitude of blast jets 72, arranged in a row transversely with respect to the longitudinal extension of the foil web 1 and over its entire width, are arranged, viewed in the conveying direction D1 of the foil web 1, downstream of the take-up station III with the fresh winding shaft 3. The charging device 6 and the blower device 7 are arranged in a common holding device 8 and can be pivoted together with it.

A strong electrostatic field E is generated by the charging electrode by which the leading end piece 10 of the foil web 1 is electrostatically charged within a very short time. An air flow L is generated by the blower device 7, which is directed opposite the conveying direction D1 of the foil web 1 and in the direction of the fresh winding shaft 3. The jets 72 are arranged so that the exiting air flow L impinges on the side of the foil web 1 which faces away from the winding shaft 3 and lifts the web off the contact roller 2 and deflects it toward the winding shaft 3. The foil web 1 simultaneously gets into the electrostatic field E between the discharge device 6 and the grounded fresh winding shaft 3 and is electrostatically charged. Thus, the leading end piece 10 of the foil web 1 automatically adheres to the surface of the fresh winding shaft 3 because of the electrostatic charge and is carried along in the direction of rotation D2, so that there is an automatic take-up of the continuously arriving foil web on the fresh winding shaft. The transfer of the fresh winding shaft 3 with the taken-up foil web into the winding station II occurs, for example, in the manner described in German Patent Reference DE 42 13 712 C2.

The electrical field generated by the charging device 6 is created by a large potential difference of up to 40 kV, for example 30 kV, while the blower device 7 simultaneously generates a very strong air flow L, which acts at a high speed on the leading end piece 10 of the foil web 1. It is thus assured with this combination that the leading end piece 10 of the foil web 1 is dependably deflected onto the fresh winding shaft 3 in the take-up station III and automatically adheres there, even at a very high conveying speed P1 and a correspondingly high number of revolutions D1 of the contact roller 2.

Figure 4:
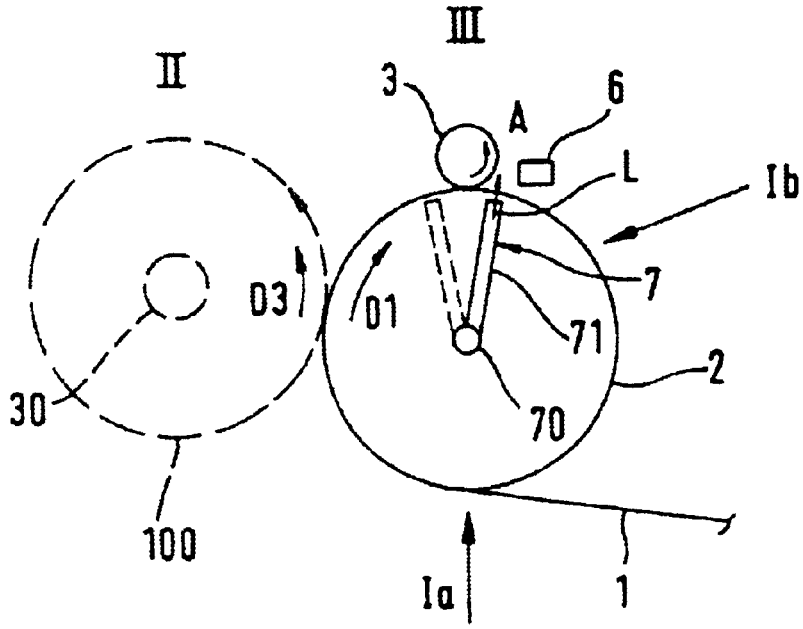
FIG. 4 shows a schematic representation of a winding device with the blower device arranged in the contact roller.

Another possible embodiment of the winding device, as shown in FIG. 4, only differs from the previous winding device by the arrangement of the blower device 7. The arrangement of the blower device 7 drawn in solid lines can be employed when the foil web 1 is conveyed to the inlet station Ia, while the position of the blower device shown in dashed lines can be used when the foil web 1 is conveyed to the inlet station Ib.

In the exemplary embodiment of FIG. 4, the blower device 7 is arranged in the interior of the contact roller 2 for generating the air flow L on the leading end piece 10 of the foil web 1, and comprises one, preferably a multitude of blast air conduits 71 with blast jets 72. These blast air conduits 71 are supplied with blast air from a compressed air source, not represented, through an entry opening 70 entering through the front of the contact roller 2 and terminate in blast jets 72 which end directly on the inner circumference of the contact roller 2 downstream, viewed in the conveying direction of the foil web 1, of the take-up station III supporting the fresh winding shaft 3. The contact roller 2 has a perforated surface, so that the air flow exiting the blast jets 72 exits from the desired area downstream of the take-up station and of the fresh winding shaft 3 through the perforated surface of the contact roller 2, in the direction of the surface of the fresh winding shaft 3 and in the process acts on the leading end piece 10 of the foil web 1 in accordance with the arrow A and deflects it in the direction A toward the surface of the fresh winding shaft 3.

The winding device shown in FIG. 1 is designed so that, depending on the desired orientation of the foil web 1 wound into a coil, the contact roller 2 can be operated in different directions of rotation, as described in detail in German Patent Reference DE 42 13 712 C2. Thus, the winding device in accordance with FIG. 1 is not only suited to be driven by the contact roller 2 rotating clockwise, which results in a course of the foil web 1 along the solid lines, but a counterclockwise operation of the contact roller 2 is also possible, which results in a course of the foil web 1 shown in dash-dotted lines.

Figure 5:
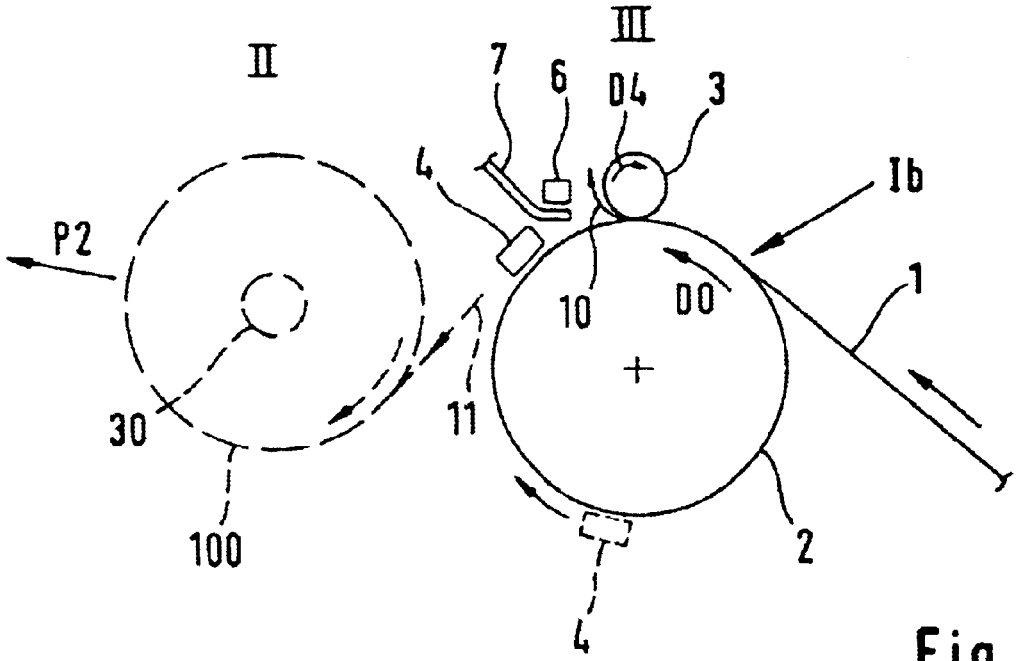
FIG. 5 shows a schematic representation of a process of take-up on a fresh winding shaft when feeding the foil web to a counterclockwise-turning contact roller in accordance with FIG. 1.

As shown in FIG. 5, in such an operating state with the inlet station Ib for the foil web 1, the adhesive-free take-up on a fresh winding shaft 3 in the take-up station III for performing a winding shaft change is also possible. In this case, the charging device 6 and the blower device 7 are arranged in the direction of rotation of the contact roller 2 and the conveying direction indicated by the arrows DQ in FIG. 5, downstream of the take-up station III supporting the fresh winding shaft 3, for example in approximately an eleven o'clock position of the contact roller 2, and in an area in which the transverse cutting device 4 is also arranged in its activated position. In this case, it is possible because of the effect of the charging device 6 and the blower device 7 on the leading end piece 10 of the foil web 1 formed in the transverse cutting device 4 to deflect the former away from the surface of the contact roller 2 in the direction toward the fresh winding shaft 3, to which it adheres because of the electrostatic charge generated by the charging device 6. Thereafter, the fresh winding shaft 3 can be transferred to the winding station II, and the foil web 1 can be continuously wound into a new coil.

In a dependable manner, the winding device of this invention and the method make possible an adhesive-free take-up on a fresh winding shaft in the course of a winding shaft change, in particular at high feed speeds of the foil web 1 of, for example, more than 100 m/min and/or foil thicknesses of more than 0.050 mm. Thus, the winding devices in accordance with this invention can also be employed for continuous production of foil webs in connection with powerful extrusion devices.

German Patent Reference 101 16 973.6, the priority document corresponding to this invention, and its teachings are incorporated, by reference, into this specification.

What is claimed is:

1. In a device for winding up a continuously arriving foil web into a coil on a winding shaft, having a rotatably driveable contact roller for feeding the foil web in a conveying device, and assigned to the contact roller a winding station for the winding shaft for winding the coil, a take-up station for receiving a fresh winding shaft used during a winding shaft change in the winding station for being exchanged with the winding shaft on which a coil of the foil web has been wound, and a transverse cutting device for transversely cutting the foil web between the winding station and the take-up station, wherein during the winding shaft change the winding shaft supporting the coil is removed out of the winding station, wherein the transverse cutting device for transversely cutting the foil web can be moved from a rest position into a working position, wherein while cutting the foil web a leading end piece of the following foil web is formed, wherein a leading end piece of the foil web thus formed can be conducted to the fresh winding shaft located in the take-up station and can be wound on the fresh winding shaft, and wherein after receiving the leading end piece of the foil web the fresh winding shaft can be transferred from the take-up station into the winding station, the improvement comprising:

when viewed in a conveying direction of the foil web (1), a charging device (6) and a blower device (7) provided downstream of the take-up station (III) receiving the fresh winding shaft (3), the leading end piece (10) of the foil web (1) formed by the transverse cutting device (4), electrostatically chargeable by the charging device (6), and an air stream generated by the blower device (7) acting on the leading end piece (10) of the foil web in an area between the contact roller (2) and the end piece of the foil web (1).

2. In the winding device in accordance with claim 1, wherein the charging device (6) has a charging electrode extending transversely over an entire width of the foil web (1).

3. In the winding device in accordance with claim 2, wherein the blower device (7) comprises a multitude of blast jets (72) arranged over the entire width of the foil web (1).

4. In the winding device in accordance with claim 3, wherein during a winding shaft change at least one of the blower device and the discharge device moveable out of the rest position into an operating position and following termination of the winding shaft change moveable back into the rest position.

5. In the winding device in accordance with claim 4, wherein the contact roller (2) is perforated at a circumference of the contact roller (2) and the blower device (7) is arranged inside the contact roller (2) and has at least one blast air conduit (71) with a blowerjet (72) conducted to a circumferential area of the contact roller (2), which when viewed in the conveying direction of the foil web is located downstream of the take-up station (III), and an air flow (L) from the at least one blast air conduit (71) and the blower jet (72) exits through the perforated circumference of the contact roller (2) toward a second circumference of the fresh winding shaft (3).

6. In the winding device in accordance with claim 5, wherein the charging device (6) is charged with an electrical potential of up to 40 kV.

7. In the winding device in accordance with claim 6, wherein the contact roller (2) is selectively driven in different rotation directions.

8. In the winding device in accordance with claim 1, wherein the blower device (7) comprises a multitude of blast jets (72) arranged over an entire width of the foil web (1).

9. In the winding device in accordance with claim 1, wherein during a winding shaft change at least one of the blower device and the discharge device moveable out of the rest position into an operating position and following termination of the winding shaft change moveable back into the rest position.

10. In the winding device in accordance with claim 1, wherein the contact roller (2) is perforated at a circumference of the contact roller (2) and the blower device (7) is arranged inside the contact roller (2) and has at least one blast air conduit (71) with a blower jet (72) conducted to a circumferential area of the contact roller (2), which when viewed in the conveying direction of the foil web is located downstream of the take-up station (III), and an air flow (L) from the at least one blast air conduit (71) and the blower jet (72) exits through the perforated circumference of the contact roller (2) toward a second circumference of the fresh winding shaft (3).

11. In the winding device in accordance with claim 1, wherein the charging device (6) is charged with an electrical potential of up to 40 kV.

12. In the winding device in accordance with claim 1, wherein the contact roller (2) is selectively driven in different rotation directions.

13. In a method for winding a continuously arriving foil web into a coil on a winding shaft and for performing a winding shaft change for exchanging the winding shaft on which the coil has been wound for a fresh winding shaft, having a winding device with a contact roller over which the foil web is supplied and is received on a winding shaft rolling off on the contact roller and is wound to form the coil, and having a transverse cutting device for the foil web for cutting the foil web while forming a leading end of the following cut-off foil web and for placing on a fresh winding shaft, and a conveying device for conveying the fresh winding shaft to be exchanged for the winding shaft on which the coil has been wound during a winding shaft change, wherein at a start of the winding shaft change the fresh winding shaft is placed on the contact roller while forming a contact gap, and the foil web is cut one of prior to passing through the contact gap and after having passed through the contact gap, and the leading end of the foil web formed during cutting is taken up by the fresh winding shaft, the improvement comprising: the leading end (10) of the foil web being electrostatically charged prior to being taken up by the fresh winding shaft (3) and being deflected from the contact roller (2) by a blast air directed toward a circumference of the fresh winding shaft (3).

14. In the method in accordance with claim 13, wherein for performing a winding shaft change the transverse cutting device is moved into a position between the take-up station (III) and the winding station (II), the fresh winding shaft is brought into the take-up station (III) by the conveying device wherein the fresh winding shaft is set into a rotating movement on the contact roller prior to being deposited in the take-up station and the charging device is switched on as soon as the fresh winding shaft rests on the contact roller (2) while forming a contact gap, wherein the electrostatic charge is provided by an electrical voltage drop between the foil web and the fresh winding shaft, then the transverse cutting device is activated and the foil web is cut by the transverse cutter, the blower device is activated simultaneously with the transverse cutting of the foil web and an air flow is generated, wherein a new leading end piece of the following foil web formed in the transverse cutting device is lifted by air flow and is conducted against the fresh winding shaft by the static charge and is wound up, the winding shaft in the winding station on which the coil had been wound is removed from the winding station, and then the fresh winding shaft with the taken-up end piece of the foil web is transferred from the take-up station (III) to the winding station (II) for winding a new coil.

* * * * *